US007364130B2

(12) United States Patent
Lai

(10) Patent No.: US 7,364,130 B2
(45) Date of Patent: Apr. 29, 2008

(54) ARTIFICIAL CHRISTMAS TREE STAND

(76) Inventor: Chung-Ho Lai, 9F-2, No. 152, Sec. 1, Chung Shiao E. Rd., Taipei (TW)

( * ) Notice: Subject to any disclaimer, the term of this patent is extended or adjusted under 35 U.S.C. 154(b) by 350 days.

(21) Appl. No.: 11/266,673

(22) Filed: Nov. 3, 2005

(65) Prior Publication Data

US 2006/0278802 A1 Dec. 14, 2006

(30) Foreign Application Priority Data

Apr. 30, 2005 (CN) ..... 2005 2 0057761

(51) Int. Cl.
*F16M 13/00* (2006.01)

(52) U.S. Cl. ..... 248/519; 248/588

(58) Field of Classification Search ..... 248/519, 248/521, 525, 588, 169, 171, 166
See application file for complete search history.

(56) References Cited

U.S. PATENT DOCUMENTS 3,787,018 A * 1/1974 Nathan ..... 248/165
4,288,052 A * 9/1981 Scott ..... 248/188.6
6,234,443 B1 * 5/2001 Tsai et al. ..... 248/519
6,293,512 B1 * 9/2001 Ho ..... 248/579

* cited by examiner

*Primary Examiner*—Amy J. Sterling

(57) ABSTRACT

An improved artificial Christmas tree stand includes a first unit and a second unit. A fixed piece is provided on a top portion of the first unit, and an upper hole is centrally provided in the fixed piece. A moveable piece is provided on each first and second unit, and a hole is centrally provided in the moveable piece. A substantially rectangular hole is provided on the moveable piece. A locking element is connected to the moveable piece of the second unit and has a locking portion. When the stand is not in use, we can disengage the locking portion from two substantially rectangular holes and rotate the first unit with respect to the second unit for a certain angle until they press against each other. Now, the folded stand may be easily stored away.

6 Claims, 5 Drawing Sheets

ARTIFICIAL CHRISTMAS TREE STAND

BACKGROUND OF THE INVENTION

1. Field of the Invention

The invention generally relates to a stand. More particularly, the invention relates to an improved stand that may be used to hold an artificial Christmas tree.

2. Description of the Prior Art

Christmas is one of the most important holidays in Europe and the US. More and more people living in the cities of this country also celebrate Christmas. A Christmas tree is usually used for the Christmas celebration; however, to use less of these trees and be friendly to our environment, artificial Christmas trees made of plastic material have been widely used to replace natural Christmas trees.

To hold a Christmas tree, a stand is needed. Referring to FIG. 1, a conventional artificial Christmas tree stand comprise a first unit 01, a second unit 02 and two tubular pieces 011 and 021. A middle portion of the first unit 01 is connected with the tubular piece 011, and a middle portion of the second unit 02 is connected with the tubular piece 021. The first unit 01 may be rotated with respect to the second unit 02. In use, the first unit 01 is rotated for a certain angle so that the first unit 01 is perpendicular to the second unit 02. Also, each of the two tubular pieces 011 and 021 has a bore so as to securely hold an artificial Christmas tree. In the manufacturing of the two tubular pieces, more material is needed, and this results in a higher production cost.

SUMMARY OF THE INVENTION

The present invention is to provide an improved artificial Christmas tree stand in which less material is used and hence the production cost may be lowered.

The improved artificial Christmas tree stand of the present invention comprises a first unit and a second unit. The first unit is substantially triangular. A fixed piece is provided on a top portion of the first unit, and an upper hole is centrally provided in the fixed piece. A moveable piece is provided on a bottom portion of the first unit, and a lower hole is centrally provided in the moveable piece. A substantially rectangular hole is provided near the lower hole on the moveable piece. The second unit is substantially triangular. An upper moveable piece is provided on a top portion of the second unit, and the area of the upper moveable piece is smaller than that of the fixed piece of the first unit. An upper hole is centrally provided in the upper moveable piece. A lower moveable piece is provided on a bottom portion of the second unit, and a lower hole is centrally provided on the lower moveable piece. A substantially rectangular hole is provided near the lower hole on the lower moveable piece of the second unit. A locking element is connected to the lower moveable piece and has a locking portion. To assemble the stand, first, make the upper moveable piece of the second unit press against the underside of the fixed piece of the first unit, and make the moveable piece of the first unit rest on the lower moveable piece of the second unit. Then, rotate the first unit with respect to the second unit for a certain angle until the substantially rectangular hole of the first unit and the substantially rectangular hole of the second unit are aligned and hence the locking portion of the locking element locks up the two units. When the stand is not in use, we can disengage the locking portion from the two substantially rectangular holes and rotate the first unit with respect to the second unit for a certain angle until they press against each other. Now, the folded stand may be easily stored away.

These features and advantages of the present invention will be fully understood and appreciated from the following detailed description of the accompanying drawings.

These features and advantages of the present invention will be fully understood and appreciated from the following detailed description of the accompanying Drawings.

DETAILED DESCRIPTION OF THE PREFERRED EMBODIMENT

Figure 1:
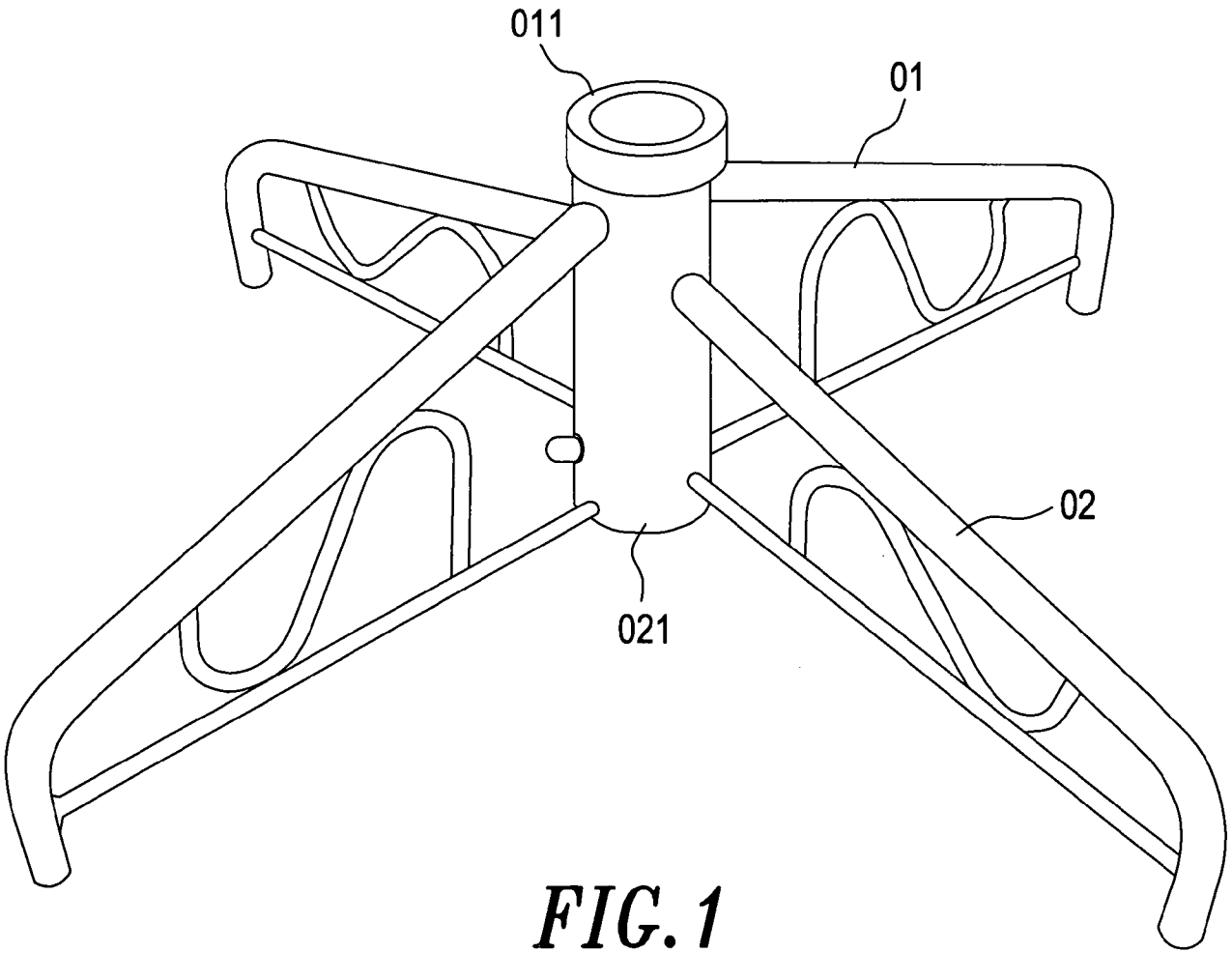
FIG. 1 PRIOR ART
FIG. 1 is a perspective view showing the conventional artificial Christmas tree stand.
Figure 2A:
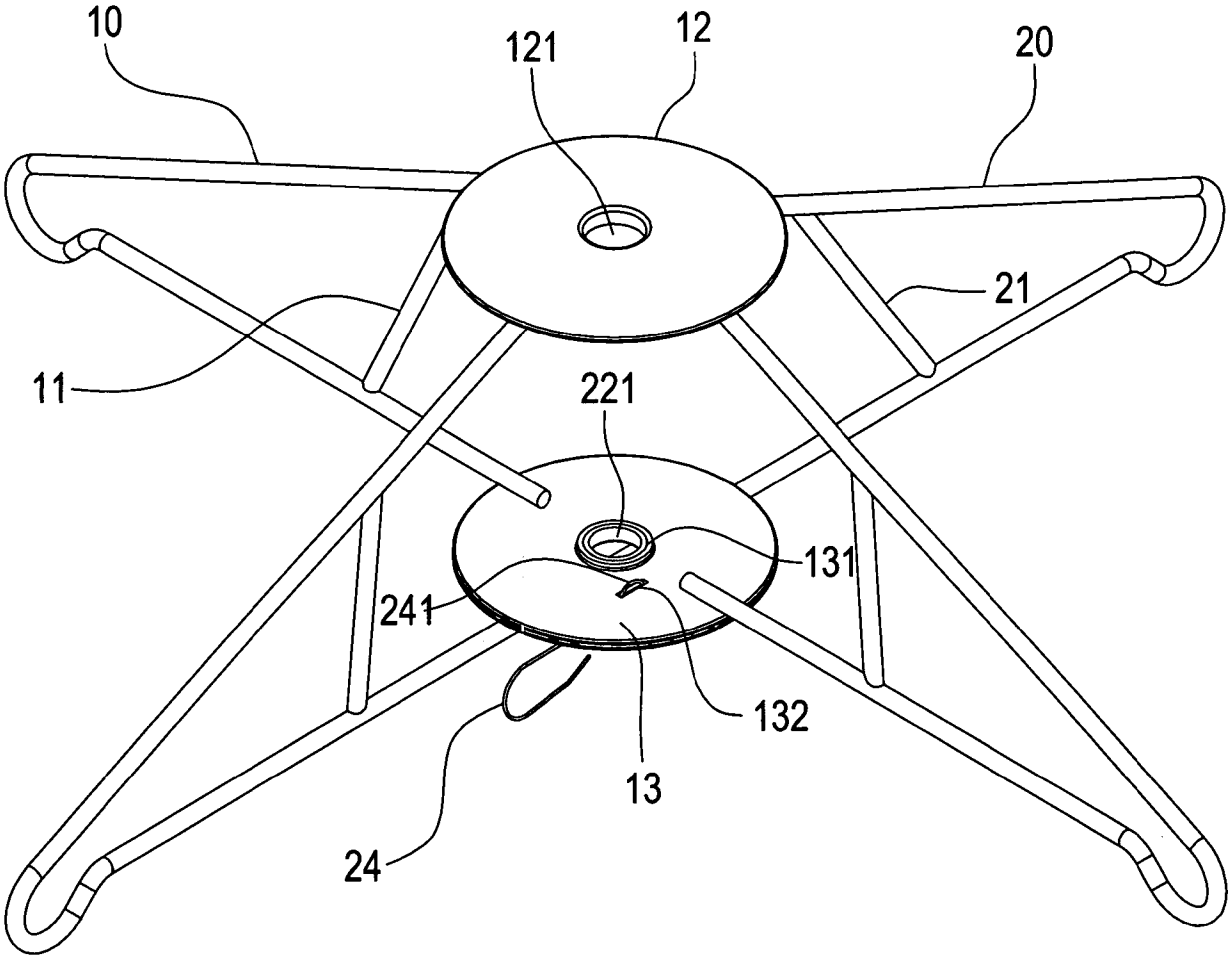
FIGS. 2A, 2B and 2C are three perspective views showing the improved artificial Christmas tree stand of the present invention.
Figure 2B:
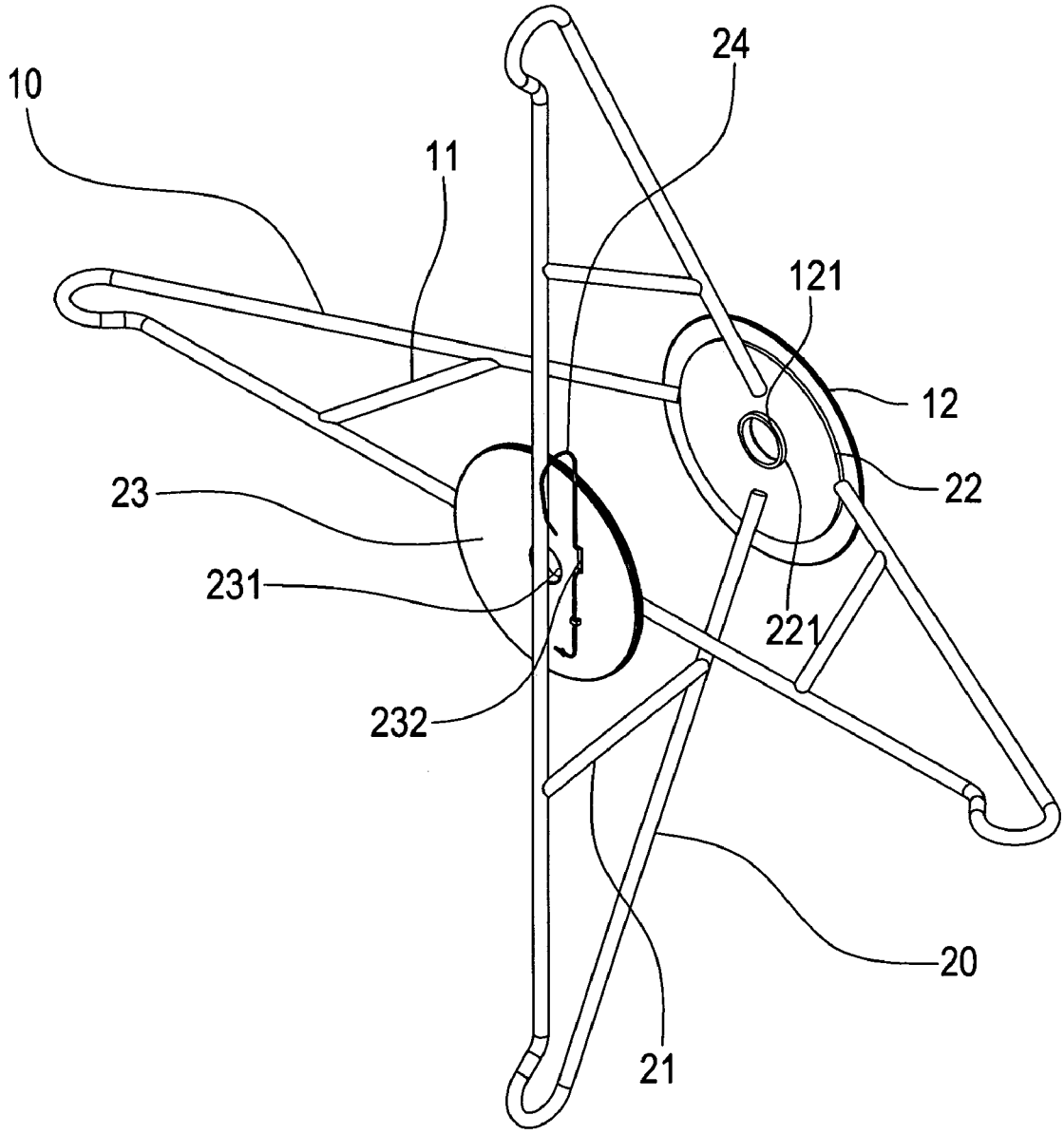
Figure 2C:
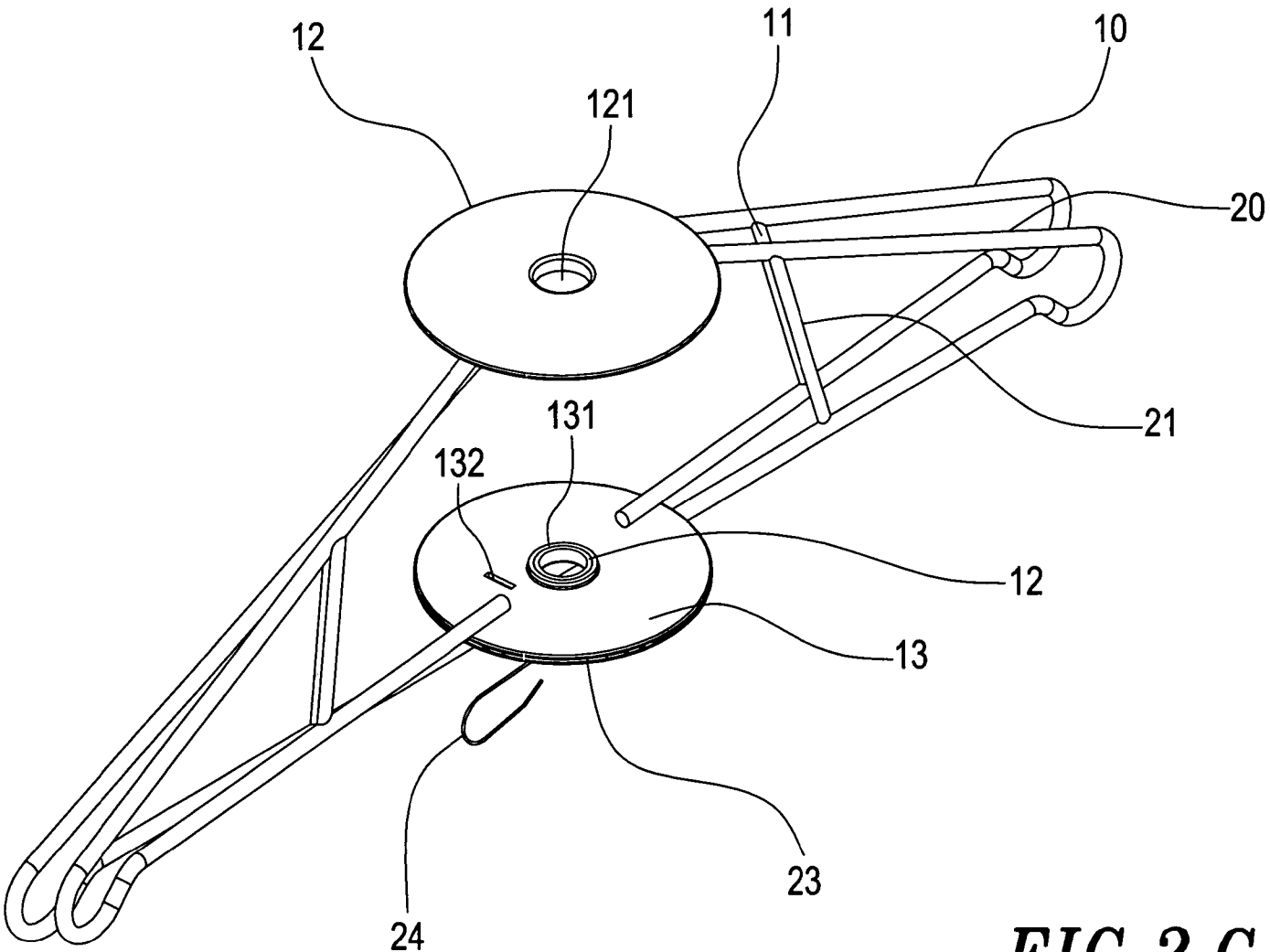

Referring to FIGS. 2A, 2B and 2C, the improved artificial Christmas tree stand of the present invention comprises a first unit 10 and a second unit 20.

The first unit 10 is substantially triangular. At least a supporting rod 11 is provided on the first unit 10. A fixed piece 12 is provided on a top portion of the first unit 10. An upper hole 121 is centrally provided in the fixed piece 12 so as to hold an artificial Christmas tree. A moveable piece 13 is provided on a bottom portion of the first unit 10. A lower hole 131 is centrally provided in the moveable piece 13 so as to hold an artificial Christmas tree. A substantially rectangular hole 132 is provided near the lower hole 131 on the moveable piece 13. The fixed piece 12 may have a dish shape, and the moveable piece 13 may be a circular plate.

The second unit 20 is substantially triangular. At least a supporting rod 21 is provided on the second unit 20. An upper moveable piece 22 is provided on a top portion of the second unit 20. The area of the upper moveable piece 22 is smaller than that of the fixed piece 12. An upper hole 221 is centrally provided in the upper moveable piece 22 so as to hold a Christmas tree. A lower moveable piece 23 is provided on a bottom portion of the second unit 20. A lower hole 231 is centrally provided on the lower moveable piece 23 so as to hold an artificial Christmas tree. A substantially rectangular hole 232 is provided near the lower hole 231 on the lower moveable piece 23. A locking element 24 is connected to the lower moveable piece 23 and has a locking portion 241. The upper moveable piece 22 may have a dish shape, and the lower moveable piece 23 may be a circular plate.

To assemble the stand, first, make the upper moveable piece 22 of the second unit 20 press against the underside of the fixed piece 12 of the first unit 10, and make the moveable piece 13 of the first unit 10 rest on the lower moveable piece 23 of the second unit 20. Then, rotate the first unit 10 with respect to the second unit 20 for a certain angle—until the two substantially rectangular holes 132 and 232 are aligned and hence the locking portion 241 of the locking element 24 locks up the two units 10 and 20. When the stand is not in use, we can disengage the locking portion 241 from the two substantially rectangular holes 132 and 232, and rotate the first unit 10 with respect to the second unit 20 for a certain angle—until they press against each other. Now, the folded stand may be easily stored away.

Figure 3:
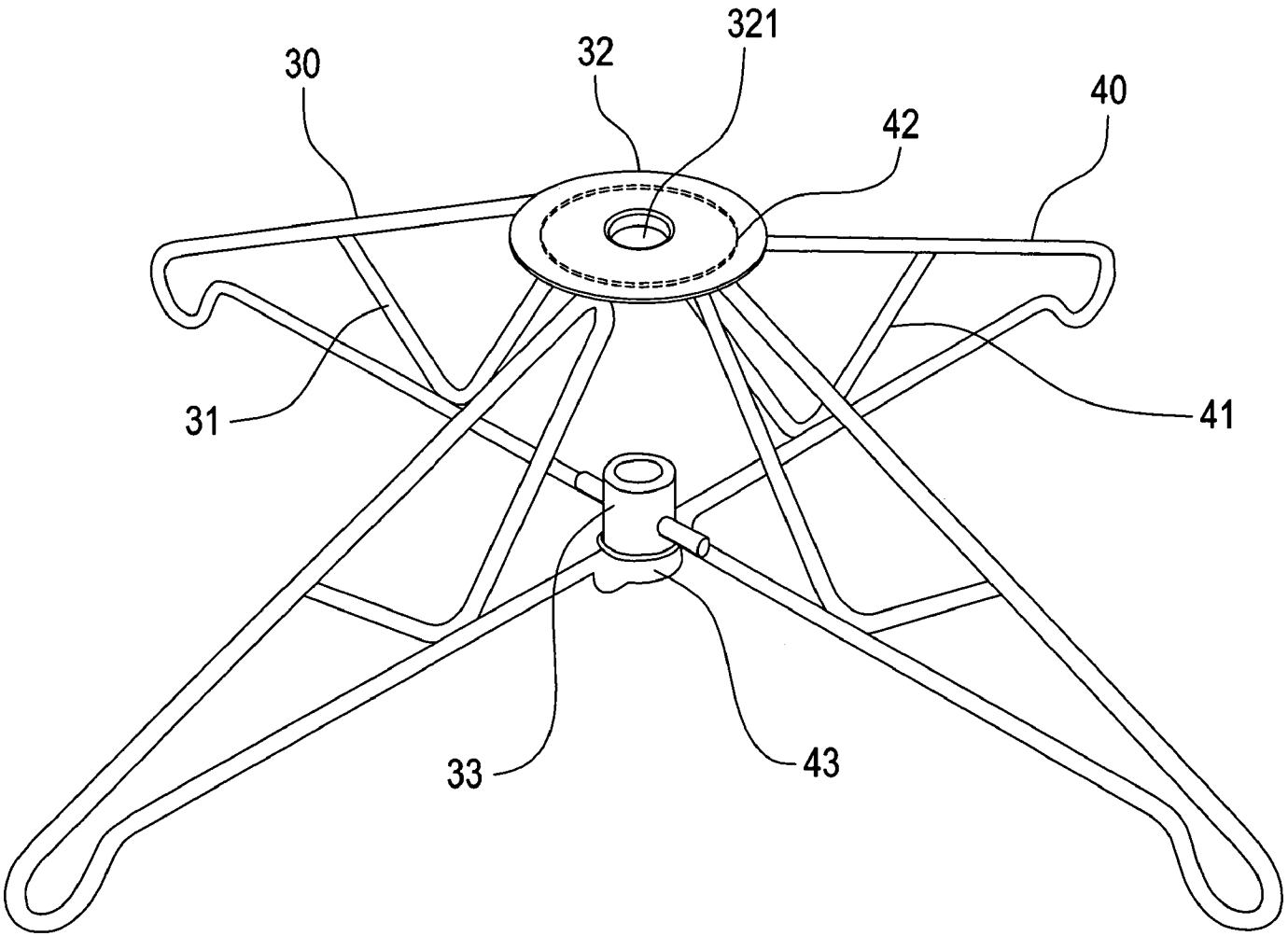
FIG. 3 is a perspective view showing another embodiment of the present invention.

Referring to FIG. 3, another embodiment of the present invention comprises a first unit 30 and a second unit 40.

The first unit 30 is substantially triangular. At least a supporting rod 11 is provided on the first unit 30. A fixed piece 32 is provided on a top portion of the first unit 30. An upper hole 321 is centrally provided in the fixed piece 32 so as to hold an artificial Christmas tree. A moveable piece 33 is provided on a bottom portion of the first unit 30. A lower hole 331 is centrally provided in the moveable piece 33 so as to hold an artificial Christmas tree. The fixed piece 32 may have a dish shape, and the moveable piece 33 may be a hollow cylinder.

The second unit 40 is substantially triangular. At least a supporting rod 41 is provided on the second unit 40. An upper moveable piece 42 is provided on a top portion of the second unit 40. The area of the upper moveable piece 42 is smaller than that of the fixed piece 32. A lower moveable piece 43 is provided on a bottom portion of the second unit 40. The lower moveable piece 43 may be an engagement piece that can engage with the moveable piece 33.

To assemble the stand, first, make the upper moveable piece 42 of the second unit 40 press against the underside of the fixed piece 32 of the first unit 30, and make the moveable piece 33 of the first unit 30 rest on and engage with the lower moveable piece 43 of the second unit 40. Now, the first unit 30 may be rotated with respect to the second unit 40. When the stand is not in use, we may rotate the first unit 30 with respect to the second unit 40 for a certain angle—until the first unit 30 presses against to the second unit 40. Now, the folded stand may be easily stored away.

In contrast to the prior art stands, the improved artificial Christmas tree stand of the present invention has the following advantages:

1. In the manufacturing of the improved artificial Christmas tree stand of the present invention, less material is used and hence the production cost may be lowered.

2. At least a supporting rod is provided for each unit so as to enhance its structural strength.

3. The lower end of an artificial Christmas tree may rest on and be supported by a horizontal steel rod of the second unit.

Although two preferred embodiments of the present invention have been described in detail hereinabove, it should be understood that the preferred embodiments are to be regarded in an illustrative manner rather than a restrictive manner, and many variations and modifications of the basic inventive concepts herein taught still fall within the scope of the present invention.

From the above, we can see that this invention is innovative in terms of design and has several practical advantages that the prior art stands do not have. It is hoped that this patent application will be approved.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved Christmas tree stand, comprising:

a first unit;

a fixed piece, provided on a top portion of the first unit;

an upper hole, centrally provided in the fixed piece so as to hold a Christmas tree;

a moveable piece, provided on a bottom portion of the first unit;

a lower hole, centrally provided in the moveable piece so as to hold the Christmas tree;

a first rectangular hole, provided near the lower hole on the moveable piece;

a second unit;

an upper moveable piece, provided on a top portion of the second unit;

an upper hole, centrally provided in the upper moveable piece so as to hold the Christmas tree;

a lower moveable piece, provided on a bottom portion of the second unit;

a lower hole, centrally provided on the lower moveable piece so as to hold the Christmas tree;

a second rectangular hole, provided near the lower hole on the lower moveable piece; and a locking element, connected to the lower moveable piece of the second unit and having a locking portion;

wherein, in order to assemble the stand, first, make the upper moveable piece press against the underside of the fixed piece, and make the moveable piece rest on the lower moveable piece, then, rotate the first unit with respect to the second unit until the first and the second rectangular holes are aligned and the locking portion locks up the first and the second units, when the stand is not in use, the locking portion is disengaged from the first and the second rectangular holes, and rotate the first unit with respect to the second unit until the first and the second units press against each other.

2. The improved artificial Christmas tree stand as in claim 1, wherein the fixed piece has a dish shape.

3. The improved artificial Christmas tree stand as in claim 1, wherein the upper moveable piece has a dish shape.

4. The improved artificial Christmas tree stand as in claim 1, wherein the moveable piece is a circular plate, and the lower moveable piece is a circular plate.

5. The improved artificial Christmas tree stand as in claim 1, wherein the moveable piece is a hollow cylinder, and the lower moveable piece is an engagement piece to engage with the moveable piece.

6. The improved artificial Christmas tree stand as in claim 1, wherein both the first and the second units are triangular, and each of the first and the second units is provided with at least a supporting rod.

* * * * *